US006920916B2

(12) United States Patent
Higashiyama

(10) Patent No.: US 6,920,916 B2
(45) Date of Patent: Jul. 26, 2005

(54) LAYERED HEAT EXCHANGERS

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/451,150

(22) PCT Filed: Dec. 26, 2001

(86) PCT No.: PCT/JP01/11449

§ 371 (c)(1),
(2), (4) Date: Dec. 2, 2003

(87) PCT Pub. No.: WO02/054001

PCT Pub. Date: Jul. 11, 2002

(65) Prior Publication Data

US 2004/0134645 A1 Jul. 15, 2004

(30) Foreign Application Priority Data

Dec. 28, 2000 (JP) ..... 2000-400623

(51) Int. Cl.[7] ..... F28D 1/06
(52) U.S. Cl. ..... 165/153; 165/176
(58) Field of Search ..... 165/153, 148, 165/152, 176

(56) References Cited

U.S. PATENT DOCUMENTS

| | | | | |
|---|---|---|---|---|
| 5,348,081 | A * | 9/1994 | Halstead et al. | 165/153 |
| 6,401,804 | B1 * | 6/2002 | Shimoya et al. | 165/153 |
| 2002/0017382 | A1 * | 2/2002 | Nakado et al. | 165/152 |
| 2003/0192682 | A1 * | 10/2003 | Lowenstein et al. | 165/153 |

FOREIGN PATENT DOCUMENTS

| | | |
|---|---|---|
| JP | 62-46195 | 2/1987 |
| JP | 4-22225 | 5/1992 |
| JP | 4-254169 | 9/1992 |
| JP | 6-39252 | 10/1994 |
| JP | 8-61807 | 3/1996 |
| JP | 9-318195 | 12/1997 |
| JP | 10-153358 | 6/1998 |
| JP | 10-170098 | 6/1998 |
| JP | 2000-18878 | 1/2000 |
| JP | 2000-266492 | 9/2000 |
| JP | 2001-108392 | 4/2001 |

* cited by examiner

*Primary Examiner*—Teresa J. Walberg
(74) *Attorney, Agent, or Firm*—Oblon, Spivak, McClelland, Maier & Neustadt, P.C.

(57) ABSTRACT

A layered heat exchanger, for example for use for motor vehicle coolers. To provide a turn portion in the heat exchanger for changing flow direction of a fluid flowing zigzag through a fluid circuit, a metal plate is provided at the upper or lower ends of a partition ridge with a fluid flow direction changing passage forming caved portion having a bottom wall of circular-arc cross section. Front and rear upper or lower tank portions are held in communication with each other through a fluid flow direction changing passage of approximately circular cross section and formed by the caved portions opposed to each other. The turn portion is diminished in stress concentrated thereon due to fluid internal pressure and given an increased resistance to pressure to effectively prevent tank side walls from breaking, consequently making it possible to decrease the metal plates thicknesses, to achieve a cost reduction by the decreased thickness and to assure an improved heat exchange efficiency.

8 Claims, 15 Drawing Sheets

LAYERED HEAT EXCHANGERS

DETAILED DESCRIPTION OF THE INVENTION

1. Technical Field of the Invention

The present invention relates to layered heat exchangers, for example, for use as layered evaporators for motor vehicle coolers.

2. Prior Art

FIGS. 17 and 18 show part of an aluminum plate for use in fabricating an aluminum layered heat exchanger for use as a conventional evaporator for motor vehicle coolers.

With reference to these drawings, the aluminum plate 40 conventionally has formed in one surface thereof front and rear fluid channel forming recessed portions 42*a*, 42*b* divided by a vertically elongated partition ridge 41, front and rear upper tank forming recessed portions 43*a*, 43*b* continuous with the upper ends of these portions 42*a*, 42*b* and having a larger depth than these portions, and front and rear lower tank forming recessed portions (not shown) continuous with the lower ends of these portions 42*a*, 42*b* and having a larger depth than these portions. The front and rear upper tank forming recessed portions 43*a*, 43*b* have respective fluid passage apertures 44*a*, 44*b* formed in their bottom wall. The front and rear lower tank forming recessed portions (not shown) have respective fluid passage apertures formed in their bottom wall.

Two adjacent aluminum plates 40, 40 are fitted together in superposed layers with their recessed surfaces opposed to each other to join the opposed partition ridges 41, 41 of the aluminum plates 42, 42 to each other and to join opposed peripheral edges 45, 45 thereof to each other, whereby a flat tube portion is formed which has front and rear flat channels, and front and rear upper tank portions, and front and rear lower tank portions continuous with the channel portions. Many such flat tube portions are arranged in parallel to cause the front upper tank portions of the adjacent parallel tube portions to communicate with each other, the rear upper tank portions thereof to communicate with each other, the front lower tank portions thereof to communicate with each other, and the rear lower tank portions thereof to communicate with each other.

To improve the heat exchanger in heat exchange efficiency, the refrigerant circuit is so designed as to cause the refrigerant to flow zigzag through the entire core of the exchanger. For this purpose, the assembly of many flat tube portions is divided into flat tube blocks. The refrigerant circuit has turn portions provided in one of the blocks for changing the direction of flow of the refrigerant from one side of each flat tube portion thereof to the other side, for example, from the front upper tank portion to the rear upper tank portion. The turn portion comprises a communication portion 50 for holding the front and rear upper tank forming recessed portions 43*a*, 43*b* of the aluminum plate 40 in communication with each other. A refrigerant flow direction changing passage is formed by the communication portions 50, 50 which are opposed to each other when the adjacent aluminum plates 42, 42 are fitted and joined to each other with their recessed surfaces opposed to each other.

[Problem to be Overcome by the Invention]

With the conventional layered heat exchanger, however, the communication portion 50 for holding in communication the front and rear upper tank forming recessed portions 43*a*, 43*b* of the aluminum plate 40 has a bottom plate 51 which is flush with the bottom walls 46, 46 of these, recessed portions 43*a*, 43*a*, and these portions 43*a*, 43*b* and the communication portion 50 have the same depth. This increases the capacity of the entire tank portion at the turn portion for changing the direction of flow of the refrigerant in the flat tube portion, with the result that the stress due to the internal pressure of the refrigerant concentrates on the tank side walls, especially on the upper and lower walls 52, 52 as indicated by arrows in FIG. 16. Thus the heat exchanger has the problem that the tank side walls are lower than the other portions in limit strength against the internal pressure of the refrigerant.

Especially in recent years, it has been urgently requested to provide a structure capable of effectively preventing the tank side walls from being broken by the stress concentration due to the internal pressure of the refrigerant acting on the turn portion, in view of the cost reduction achieved by a reduction in the thickness of the plates for fabricating the heat exchanger while ensuring the efficiency of the heat exchanger.

An object of the present invention is to meet the above request by overcoming the problem of the prior art and to provide a heat exchanger wherein the tank side walls at the turn portion for changing the direction of flow of the fluid can be given an increased limit strength against the internal pressure of the refrigerant to diminish the concentration of stress on the turn portion due to the fluid internal pressure, give the turn portion sufficient resistance to pressure and effectively prevent the tank side walls from breaking, consequently making it possible to decrease the thickness of the plates for fabricating the heat exchanger, to assure the exchanger of a high efficiency and to achieve a cost reduction by the decreased thickness of metal plates.

[Means for Solving the Problem]

To achieve the above object, the present invention provides a layered heat exchanger comprising generally rectangular metal plates each having formed in one surface thereof front and rear fluid channel forming recessed portions divided by a vertically elongated partition ridge, front and rear upper tank forming recessed portions continuous with the upper ends of these channel forming portions and having a larger depth than these channel forming portions, and front and rear lower tank forming recessed portions continuous with the lower ends of these channel forming portions and having a larger depth than these portions, the front and rear upper tank forming recessed portions having respective fluid passage apertures formed in their bottom wall, the front and rear lower tank forming recessed portions having respective fluid passage apertures formed in their bottom wall, each pair of adjacent metal plates being fitted together in superposed layers with their recessed surfaces opposed to each other to join the opposed partition ridges of the metal plates to each other, to join opposed peripheral edges thereof to each other and to thereby form a flat tube portion having front and rear flat channels, and front and rear upper tank portions and front and rear lower tank portions which are continuous with the channels, a multiplicity of flat tube portions being arranged in parallel to cause the front upper tank portions of the adjacent parallel flat tube portions to communicate with each other, the rear upper tank portions thereof to communicate with each other, the front lower tank portions thereof to communicate with each other, and the rear lower tank portions thereof to communicate with each other. The layered heat exchanger is characterized in that the metal plate is provided at one of the upper end and the lower end of the partition ridge with a fluid flow direction changing passage forming caved portion having a bottom wall of circular-arc cross section, the front and rear upper tank portions of the flat tube portion or the front and rear lower tank portions thereof being held in communication with each other through a fluid flow direction changing passage having an approximately circular cross section and formed by the caved portions which are opposed to each other.

Regarding the fluid flow direction changing passage described above, the approximately circular cross section means circular or elliptical in cross section.

The bottom wall having a circular-arc cross section of the caved portion has a depth smaller than the depth of the tank forming recessed portions.

In the layered heat exchanger of the invention, the bottom wall, circular-arc in cross section, of the caved portion has, for example a depth ⅕ to ⅘, preferably ¼ to ¾, of the depth of the tank forming recessed portions.

[Embodiments of the Invention]

Embodiments of the present invention will be described below with reference to the drawings.

The terms "front," "rear," "left," "right," "upper" and "lower" as used herein are based on FIG. 1; "left" refers to the left-hand side of FIG. 1, "right" to the right-hand side thereof, "front" to the rear side of the plane of the drawing, "rear" to the front side of the plane thereof, "upper" to the upper side of the drawing, and "lower" to the lower side thereof.

The drawings show layered heat exchangers of the invention for use as layered evaporators for motor vehicle coolers.

FIGS. 1 to 11 show a first embodiment of layered evaporator of the present invention. First with reference to FIG. 1, the layered evaporator 1 of the invention is made from aluminum (including aluminum alloys), comprises a multiplicity of flat tube portions A arranged side by side, and has a refrigerant circuit which is designed to cause a refrigerant to flow zigzag through the entire interior of the evaporator 1.

With reference to FIG. 2 showing the first embodiment, the entire assembly of many flat tube portions A is divided into left and right two flat tube blocks B1, B2. Each of the blocks B1, B2 has a plurality of flat tube portions A. The refrigerant circuit is four in the number of passes, causing the refrigerant to flow upward and downward through the two blocks B1, B2 along a total of four front and rear flat channels 11*a*, 11*b*. In this case, the left block B2 of the refrigerant circuit has a turn portion 18 for changing the direction of flow of the refrigerant from the front lower tank portion 12*a* at one side of each flat tube portion A to the rear lower tank portion 12*b* at the other side thereof. This feature will be described later.

Each of the flat tube blocks B1, B2 comprises, for example, 2 to 20, preferably 2 to 15, more preferably 3 to 10, flat tube portions A.

Next with reference to FIG. 3, generally rectangular aluminum plates 2 providing the layered evaporator 1 each have formed in one surface thereof front and rear refrigerant channel forming recessed portions 4*a*, 4*b* divided by a vertically elongated partition ridge 6, front and rear upper tank forming recessed portions 3*a*, 3*b* continuous with the upper ends of these portions 4*a*, 4*b*, having a larger depth than these portions and circular when seen from the front, and front and rear lower tank forming recessed portions 5*a*. 5*b* continuous with the lower ends of these portions 4*a*, 4*b*, having a larger depth than these portions and circular when seen from the front. The front and rear upper tank forming recessed portions 3*a*, 3*b* have respective refrigerant passage apertures 13*a*, 13*b* formed in their bottom wall and circular when seen form the front. The front and rear lower tank forming recessed portions 5*a*, 5*b* have respective refrigerant passage apertures 15*a*, 15*b* formed in their bottom wall and circular when seen form the front. The ridges 6 have approximately the same height as the depth of the refrigerant channel forming recessed portions 4*a*, 4*b*.

One of the apertures 13*a*, 13*b* of the front and rear upper recessed portions 3*a*, 3*b* is provided with an annular wall 14 formed by burring and projecting outward from the recess portion 3*a* or 3*b*. One of the apertures 15*a*, 15*b* of the front and rear lower recessed portions 5*a*, 5*b* is provided with an annular wall 16*a*, 16*b* formed by burring and projecting outward from the recess portion 5*a* or 5*b*.

Two adjacent aluminum plates 2, 2 are fitted together in superposed layers with their recessed surfaces opposed to each other, and the opposed partition ridges 6, 6 of the plates 2, 2, as well as opposed peripheral edges 7, 7 thereof, are joined to each other, whereby a flat tube portion A is formed which has front and rear flat channels 11*a*, 11*b*, front and rear upper tank portions 10*a*, 10*b* and front and rear lower tank portions 12*a*, 12*b*. Inner fins 9, 9 are inserted in the respective flat channels 11*a*, 11*b* formed by the refrigerant channel forming recessed portions 4*a*, 4*b* of the adjacent aluminum plates 2, 2 (see FIGS. 3, 4 and 9).

Many such flat tube portions A are arranged side by side, and the opposed aluminum plates 2, 2 of each pair of adjacent left and right flat tube portions A, A are fitted to each other. At this time, at the front or rear upper tank portion 10*a* or 10*b*, and at the front or rear lower tank portion 12*a* or 12*b*, the annular wall 14 around the refrigerant aperture 13*a* or 13*b* in the upper tank forming recessed portion 3*a* or 3*b* of one of the aluminum plates 2 is fitted into the other aperture 13*b* or 13*a*, and the annular wall 16*a* or 16*b* around the refrigerant aperture 15*a* or 15*b* in the lower tank forming recessed portion 5*a* or 5*b* is fitted into the other aperture 15*b* or 15*a*. This causes the front upper tank portions 10*a*, 10*a* of the adjacent tube portions A, A to communicate with each other, the rear upper tank portions 10*b*, 10*b* thereof to communicate with each other, the front lower tank portions 12*a*, 12*a* thereof to communicate with each other, and the rear lower tank portions 12*b*, 12*b* thereof to communicate with each other.

Further as shown in FIG. 1, corrugated fins 24 are interposed between the front and rear channels of each pair of adjacent flat tube portions A, A. Side plates 22, 22 are arranged on the left and right outer sides of the evaporator 1, and corrugated fins 24 are also provided between each side plate 22 and the front and rear channels 11*a*, 11*b* of the tube portion A.

Further with reference to FIGS. 1, 10 and 11, a refrigerant inlet pipe 30 is connected to the right end of the front lower tank portion 12*a* of the right flat tube block B1 of the layered evaporator 1. A refrigerant outlet pipe 31 is connected to the right end of the rear lower tank portion 12*b* of the block B1. These refrigerant inlet pipe 30 and outlet pipe 31 are arranged to extend along the right side plate 22. A joint member 33 having a refrigerant inlet 34 and a refrigerant outlet 35 are attached to the upper ends of the pipes 30, 31.

As shown in FIG. 2, the entire assembly of flat tube portions A of this embodiment is divided into left and right two flat tube blocks B1, B2 and has a refrigerant circuit which is designed to permit a refrigerant to flow zigzag through the entre interior of the evaporator 1 to achieve an improved heat exchange efficiency. Especially with the layered evaporator of the present invention, the flat tube portion A of the left flat tube block B2 of the refrigerant circuit has a turn portion for changing the direction of flow of the refrigerant from the front lower tank portion 12*a* at one side of the flat tube portion A to the rear lower tank portion 12*b* at the other side thereof.

At the boundary between the left and right tube blocks B1, B2, the left end of the front upper tank portion 10*a* of the right block B1 and the right end of the front upper tank portion 10*a* of the left block B2 are in communication with each other, and the left end of the rear upper tank portion 10*b* of the right block B1 and the right end of the rear upper tank portion 10*b* of the left block B2 are similarly in communication with each other. On the other hand, the junction of the left end of the front lower tank portion 12*a* of the right block B1 and the right end of the front lower tank portion 12*a* of the left block B2 is blocked, and the junction of the left end of the rear lower tank portion 12*b* of the right block B1 and the right end of the rear lower tank portion 12*b* of the left block B2 is similarly blocked.

Thus, at the boundary between the left and right tube blocks B1, B2, the aluminum plate 2 shown in FIG. 5 is used for the end aluminum plates 2, 2 providing the flat tube portion A at the left end of the right tube block B1 and the flat tube portion A at the right end of the left tube block B2. The front and rear lower tank forming recessed portions 5*a*, 5*b* of these aluminum plates 2, 2 are not apertured in their bottom wall for the passage of the refrigerant but are provided with partition walls 8, 8.

Since the aluminum plate 2 shown in FIG. 5 is otherwise the same as the usual aluminum plate 2 shown in FIG. 3, like parts are designated by like reference numerals or symbols in the drawings concerned.

FIG. 4 further shows aluminum plates 2 which are used in the left flat tube block B2 of the refrigerant circuit shown in FIG. 2 for the turn portion for changing the direction of flow of the refrigerant from the front lower tank portion 12*a* at one side of the flat tube portion A to the rear lower tank portion 12*b* at the other side thereof.

As shown in FIG. 4, and also as shown in FIGS. 7 and 8*a* in detail, the aluminum plate 2 has at the lower end of its partition ridge 6 a caved portion 17 having a bottom wall 17*a* of circular-arc cross section and having a depth smaller than the depth of the front and rear lower tank forming recessed portions 5*a*, 5*b*. When the flat tube portion A is formed by fitting adjacent aluminum plates 2, 2 to each other in superposed layers with their recessed surfaces opposed to each other, joining the opposed ridges 6, 6 to each other and joining the opposed peripheral edges 7, 7 to each other, a passage 18 having an approximately circular cross section for changing the direction of flow of the refrigerant is formed by the caved portions 17, 17 which are opposed to each other. The front and rear lower tank portions 12*a*, 12*b* are caused to communicate with each other through the direction changing passage 18.

Since the aluminum plates 2 shown in FIG. 4 are otherwise the same as the usual aluminum plates 2 shown in FIG. 3, like parts are designated by like reference numerals or symbols in the drawings concerned.

For example, the intermediate aluminum plates 2 included in the foregoing embodiment are prepared from an aluminum blazing sheet, and the side plates 22, 22 are prepared also from an aluminum brazing sheet. The inner fins 9 and corrugated fins 24 are prepared from an aluminum sheet.

With the layered evaporator 1 described, the refrigerant introduced into the front lower tank portions 12*a* in the right tube block B1 via the refrigerant inlet pipe 30 rises through the front flat channels 11*a* of the block B1 to the front upper tank portions 10*a*, from which the refrigerant flows into the front upper tank portions 10*a* in the tube block B2 adjacent to the block B1 on the left side.

The refrigerant then flows from the front tank portions 10*a* of the block B2 downward through the front flat channels 11*a* to the front lower tank portions 12*a* at the lower end of the block B2, further flows through the turn portion of the block B2, i.e., through the direction changing passages 18 of circular cross section of the flat tube portions A into the rear lower tank portions 12*b* of the same block B2.

Subsequently, the refrigerant flows upward from the rear lower tank portions 12*b* of the block B2 to the rear upper tank portions 10*b* through the rear flat channels 11*b*, and then flows from the tank portions 10*b* into the rear upper tank portions 10*b* of the adjacent tube block B1 at the left.

The refrigerant further flows from the rear upper tank portions 10*b* in the block B1 downward through the rear flat channels 11*b* to the rear lower tank portions 12*b*, from which the refrigerant flows out of the evaporator through the outlet pipe 31.

On the other hand, air flows through the clearances between the adjacent flat tube portions A, A and between the flat tube portion A and each side plate 22 in which clearances the corrugated fins 24 are provided, and is thereby subjected to efficient heat exchange with the refrigerant through the wall surfaces of the aluminum plates 2 and the corrugated fins 24.

With the layered evaporator 1 described, the aluminum plate 2 is provided at the lower end of its partition ridge 6 with the caved portion 17 having a bottom wall 17*a* of circular-arc cross section and having a depth smaller than the depth of the front and rear lower tank forming recessed portions 5*a*, 5*b*. The front and rear upper tank portions 10*a*, 10*b* of the flat tube portion A or the front and rear lower tank portions 12*a*, 12*b* thereof are caused to communicate with each other through the refrigerant flow direction changing passage 18 having an approximately circular cross section and formed by the caved portions 17, 17 which are opposed to each other.

A layered evaporator 1 having the construction of the present embodiment was fabricated using aluminum plates 2 which were made 0.1 mm smaller in thickness than the aluminum plates of the layered evaporator of the conventional construction, and checked for pressure resistance in comparison with the evaporator of the conventional construction. Consequently, the layered evaporator according to the embodiment of the invention was found to be 25% greater than the conventional evaporator in pressure resistance.

As will be apparent from this result, the direction changing passage 18 in the layered evaporator 1 of the present invention is made narrower by the opposed bottom walls 17*a*, 17*a* having a circular-arc cross section and smaller than the front and rear lower tank forming recessed portions 5*a*, 5*b* in depth, and is consequently formed by side wall portions which have a diminished area and are reinforced by the bottom walls 17*a*, 17*a* of circular-arc cross section. At the refrigerant flow direction changing passage 18, i.e., the turn portion, the tank side walls can be given an increased limit strength against the internal pressure of the refrigerant to diminish the concentration of stress on the turn portion due to the refrigerant internal pressure, give the turn portion sufficient resistance to pressure and effectively prevent the tank side walls from breaking. Consequently, it becomes possible to decrease the thickness of the aluminum plates 2 making the heat exchanger, to assure the exchanger of a high efficiency and to achieve a cost reduction by the decreased thickness of the aluminum plates 2.

Although the passage 18 according to the first embodiment is approximately circular in cross section, the passage 18 may be elliptical or in the form of an elongated circle in cross section.

FIG. 8 shows four examples of sectional shapes of the refrigerant flow direction changing passage 18 and passage forming caved portion 17 of the aluminum plate 2.

First, FIG. 8*a* shows a first example which is according to the first embodiment described. The passage forming caved portion 17 is semicircular in cross section, and the passage 18 is accordingly generally circular in cross section. The bottom wall 17*a*, semicircular in cross section, of the caved portion 17 has a depth about ½ of the depth of the tank forming recessed portions 5*a*, 5*b*.

FIG. 8*b* shows a second example. The aluminum plate 2 has a caved portion 17 which is semicircular in cross section like the first example. However, the caved portions 17 of two aluminum plates 2, 2 as fitted together each have small rounded (circular-arc) parts 17*b*, 17*b* at upper and lower edges thereof.

FIG. 8*c* shows a third example. The caved portion 17 of the aluminum plate 2 has a circular-arc cross section which is shallower than in the first embodiment. Consequently, the passage 18 formed has an elliptical cross section which is vertically elongated. The caved portions 17 of two aluminum plates 2, 2 as fitted together each have small rounded (circular-arc) parts 17*b*, 17*b* at upper and lower edges thereof. The bottom wall 17*a*, semicircular in cross section, of each caved porion 17 has a depth about ⅓ of the depth of the tank forming recessed portions 5*a*, 5*b*.

FIG. 8*d* shows a fourth example, in which the caved portion 17 of the aluminum plate 2 has a circular-arc cross section deeper than in the first example. Accordingly, the passage 18 has an elliptical cross section elongated laterally. The caved portions 17 of two aluminum plates 2, 2 as fitted together each have small rounded (circular-arc) parts 17*b*, 17*b* at upper and lower edges thereof. The bottom wall 17*a*, semicircular in cross section, of each caved porion 17 has a depth about ⅗ of the depth of the tank forming recessed portions 5*a*, 5*b*.

FIG. 12 shows a second embodiment of the present invention, i.e., a layered evaporator 1 which is divided into right and left two flat tube blocks B1, B2. Although the refrigerant circuit is of the four pass type like the first embodiment, the refrigerant flows through the circuit in the opposite direction to the first embodiment.

Stated more specifically with reference to the second embodiment, a refrigerant inlet pipe 30 is connected to the right end of the front upper tank portion 1*a* of the right block B1 of the evaporator 1, and a refrigerant outlet pipe 31 is connected to the right end of the rear upper tank portion 10*b* of the right block B1. The left end of the front and rear upper tank portions 10*a*, 10*b* of the right block B1, and the right end of the front and rear upper tank portions 10*a*, 10*b* of the left block B2 adjacent to the block B1 are provided with partition walls 8, 8 (see FIG. 5) and are closed therewith. On the other hand, apertures 15*a*, 15*b* (see FIG. 3) for passing the refrigerant therethrough are formed in the left end of the front and rear lower tank portions 12*a*, 12*b* of the right block B1, and in the right end of the front and rear lower tank portions 12*a*, 12*b* of the left block B2 adjacent to the block B1.

Furthermore, the left flat tube block B2 of the refrigerant circuit has a turn portion 18 for changing the direction of flow of the refrigerant from the front upper tank portion 10*a* at one side of each flat tube portion A to the rear upper tank portion 10*b* at the other side thereof.

The second embodiment has the same construction as the first embodiment except that the direction of flow of the refrigerant through the refrigerant circuit of the second embodiment is opposite to that in the first embodiment, so that like parts are designated by like reference numerals or symbols throughout the drawings concerned.

FIG. 13 shows a third embodiment of the present invention, i.e., a layered evaporator 1 having a refrigerant circuit which is five in the number of passes.

According to the third embodiment, an assembly of many flat tube portions A providing the evaporator 1 comprises a front half and a rear half which are different in the number of component blocks. The front half of the evaporator 1, which includes front upper tank portions 10*a*, front flat channels 11*a* and front lower tank portions 12*a*, is divided into three blocks B1, B2, B3, whereas rear upper tank portions lob, rear flat channels 11*b* and rear lower tank portions 12*b* is divided into two blocks B4, B5. The evaporator 1 in its entirety is five in the number of passes.

A refrigerant inlet pipe 30 is connected to the beginning end of the front lower tank portion 12*a* of the right front first block B1 of the evaporator 1. A refrigerant outlet pipe 31 is connected to the rear upper tank portion 10*b* of the right rear fifth block B5.

The left end of the front lower tank portion 12*a* of the right front first block B1 and the right end of the front lower tank portion 12*a* of the central front second block B2 adjacent to the block B1 are each provided with a partition 8 (see FIG. 5) and closed therewith, whereas the left end of the front upper tank portion 10*a* of the right front block B1 and the right end of the front upper tank portion 10*a* of the central front second block B2 adjacent to the block B1 have respective apertures 15*a*, 15*b* (see FIG. 3) for passing the refrigerant therethrough.

The left end of the front upper tank portion 10*a* of the central front second block B2 and the right end of the front upper tank portion 10*a* of the left front third block B3 adjacent to the block 2 are each provided with a partition 8 (see FIG. 5) and closed therewith, whereas the left end of the front lower tank portion 12*a* of the central front second block B2 and the right end of the front lower tank portion 12*a* of the left front third block B3 adjacent to the block 2 each have an aperture 15*a* (see FIG. 3) for passing the refrigerant therethrough.

Turn portions 18 are further provided for changing the direction of flow of the refrigerant from the front upper tank portions 10*a* of the left front third block B3 of the refrigerant circuit toward rear upper tank portions 10*b* in the left rear fourth block B4.

The right end of the rear upper tank portion 10*b* of the left rear fourth block B4 and the left end of the rear upper tank portion 10*b* of the right rear fifth block B5 adjacent to the block B4 are each provided with a partition wall (see FIG. 5) and closed therewith, whereas the right end of the rear lower tank portion 12*b* of the left rear fourth block B4 and the left end of the rear lower tank portion 12*b* of the right rear fifth block B5 adjacent to the block B4 each have an aperture 15*b* (see FIG. 3) for passing the refrigerant therethrough.

In the layered evaporator 1 according to the third embodiment, the refrigerant introduced into the front lower tank portions 12*a* of the right front first block B1 through the inlet pipe 30 ascends the front flat channels 11*a* of the first block B1 to the front upper tank portions boa, from which the refrigerant flows into the front upper tank portions 10*a* in the central front second block B2 adjacent to and at the left of the block B1.

The refrigerant then descends from the portions 10*a* of the second block B2, flows into the front lower tank portions 12*a* at the lower end of the second block B2 and further into the front lower tank portions 12*a* in the left front third block B3 at the left of and adjacent to the block B2, and then ascends the front flat channels 11*a* of the third block B3 to the front upper tank portions 10*a*.

The refrigerant then flows through the turn portions of the third block B3, i.e., through the refrigerant flow direction changing passages 18 of circular cross section in the flat tube portions A, into the rear upper tank portions 10*b* in the left rear fourth block B4. Subsequently, the refrigerant flows from these portion 10*b* of the fourth block 4 downward to the rear lower tank portions 12*b* through the rear flat channels 11*b*, and then flows from these portions 12*b* into the rear lower tank portions 12*b* in the right rear fifth block B5 at the left of and adjacent to the block B4.

The refrigerant further ascends from the rear lower tank portions 12*b* of the fifth block B5 to the rear upper tank portions 10*b* through the rear flat channels 11*b*, and flows out of these portions 10*b* to the outside via the outlet pipe 31.

With the exception of the above features, the third embodiment has the same construction as the first embodiment described, so that like parts are designated by like reference numerals or symbols throughout the drawings concerned.

Next, FIG. 14 shows a fourth embodiment of the invention, i.e., a layered evaporator 1. The evaporator comprises a multiplicity of flat tube portions A, the entire assembly of which is divided into three flat tube blocks B1, B2, B3. The refrigerant circuit is six in the number of passes.

With the fourth embodiment, the right flat tube block B1 of the evaporator 1 and the central flat tube block B2 thereof adjacent to the block B1 are substantially the same as the blocks of the first embodiment in construction, and the left flat tube block B3 is additionally provided at the left of the central block B2.

This embodiment has turn portions 18 for changing the direction of flow of the refrigerant from the front upper tank portions 10*a* of the left block B3 of the refrigerant circuit to the rear upper tank portions 10*b* of the same block B3.

With the layered evaporator 1 of the fourth embodiment, the refrigerant introduced into the front lower tank portions 12*a* in the right front first block B1 via the inlet pipe 30 flows zigzag generally in the same manner as in the first embodiment through the entire refrigerant circuit which is six in the number of passes and provided inside the evaporator 1, and is drawn off to the outside via the outlet pipe 31.

With the exception of the above features, the fourth embodiment has the same construction as the first embodiment described, so that like parts are designated by like reference numerals or symbols throughout the drawings concerned.

Next, FIGS. 15 and 16 show a modified aluminum plate 2 for use in the layered evaporator 1 of the present invention. The modified plate 2 is different from the plates 2 of the first embodiment in that the modified plate 2 is provided at the upper end of the partition ridge 6 with a refrigerant flow direction changing passage forming caved portion 17 having a bottom plate 17*a* of circular-arc cross section and having a depth smaller than the depth of front and rear upper tank forming recessed portions 3*a*, 3*b*, and that these recessed portions 3*a*, 3*b*, front and rear lower tank forming recessed portions 5*a*, 5*b* and refrigerant passing apertures 13*a*, 13*b*, 15*a*, 15*b* formed in the bottom walls of these recessed portions are each in the form of an elongated circle when seen from the front.

When a flat tube portion A is formed by fitting adjacent aluminum plates 2, 2 to each other in superposed layers with their recessed surfaces opposed to each other, joining the opposed ridges 6, 6 to each other and joining the opposed peripheral edges 7, 7 to each other, a passage (not shown) having an approximately circular cross section for changing the direction of flow of the refrigerant is formed by the caved portions 17, 17 which are opposed to each other. Thus turn portions of the layered evaporator 1 are formed in the flat tube block B2 each adapted to cause the front and rear upper tank portions 10*a*, 10*b* to communicate with each other therethrough.

Accordingly, such modified aluminum plates 2 are used, for example, in layered evaporators 1 according to the second to fourth embodiments described.

According to the foregoing embodiments, refrigerant channels are formed by inserting inner fins 9 into the refrigerant channel forming recessed porions 4*a*, 4*b* of each aluminum plate 2 of the evaporator 1, whereas ridges of various shapes may be formed in these recessed portions 4*a*, 4*b* of the aluminum plate 2 by pressing the plate 2 itself. The flat channels 11*a*, 11*b* for the flow of refrigerant can be modified variously.

The overall assembly of parallel flat tube portions A providing the layered evaporator 1 may be divided into at least two blocks, or alternatively need not always be divided into blocks.

Furthermore, the layered heat exchanger of the present invention is useful not only as the evaporator for use in motor vehicle coolers but similarly applicable also to oil coolers, aftercoolers, radiators or like uses.

[Effects of the Invention]

As described above, with the fluid turn portion of the layered heat exchanger of the present invention, which is designed to cause a fluid to flow zigzag through the entire interior of the layered heat exchanger, the metal plate is provided at one of the upper end and the lower end of the partition ridge with a fluid flow direction changing passage forming caved portion having a bottom wall of circular-arc cross section, the front and rear upper tank portions of the flat tube portion or the front and rear lower tank portions thereof being held in communication with each other through a fluid flow direction changing passage having an approximately circular cross section and formed by the caved portions which are opposed to each other. In the case of the present invention, the fluid flow direction changing passage is made narrower by the opposed bottom walls of a circular-arc cross section and is consequently formed by side wall portions which have a diminished area and are reinforced by the bottom walls of circular-arc cross section. At the fluid flow direction changing passage, i.e., the turn portion, the tank side walls can be given an increased limit strength against the internal pressure of the refrigerant to diminish the concentration of stress on the turn portion due to the fluid internal pressure, give the turn portion sufficiently high resistance to pressure and effectively prevent the tank side walls from breaking. This entails the advantage of making it possible to decrease the thickness of the plates providing the heat exchanger, to assure a high heat exchange efficiency and to achieve a cost reduction by the decreased thickness of the metal plates.

The bottom wall, circular-arc in cross section, of the caved portion for forming the fluid flow direction changing passage is given a smaller depth than the tank forming recessed portions to ensure the above advantage more reliably.

BRIEF DESCRIPTION OF THE DRAWINGS

FIG. 8*a* showing a first example of cross sectional shape of aluminum plate caved portion for forming a refrigerant flow direction changing passage, FIG. 8*b* is a second example of cross sectional shape of caved portion, FIG. 8*c* is a third example of cross sectional shape of caved portion, and FIG. 8*d* is a fourth example of cross sectional shape of caved portion.

DESCRIPTION OF REFERENCE NUMERALS

Figure 1:
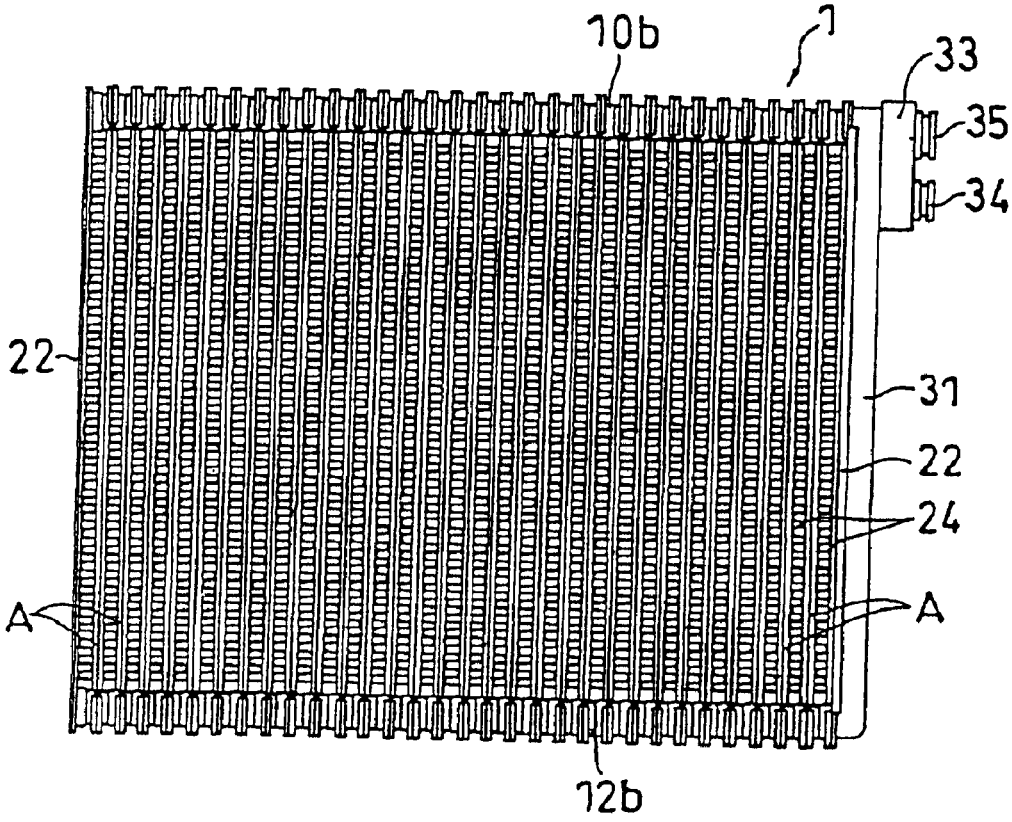
FIG. 1 is a schematic front view showing a first embodiment of layered heat exchanger of the invention.
Figure 2:
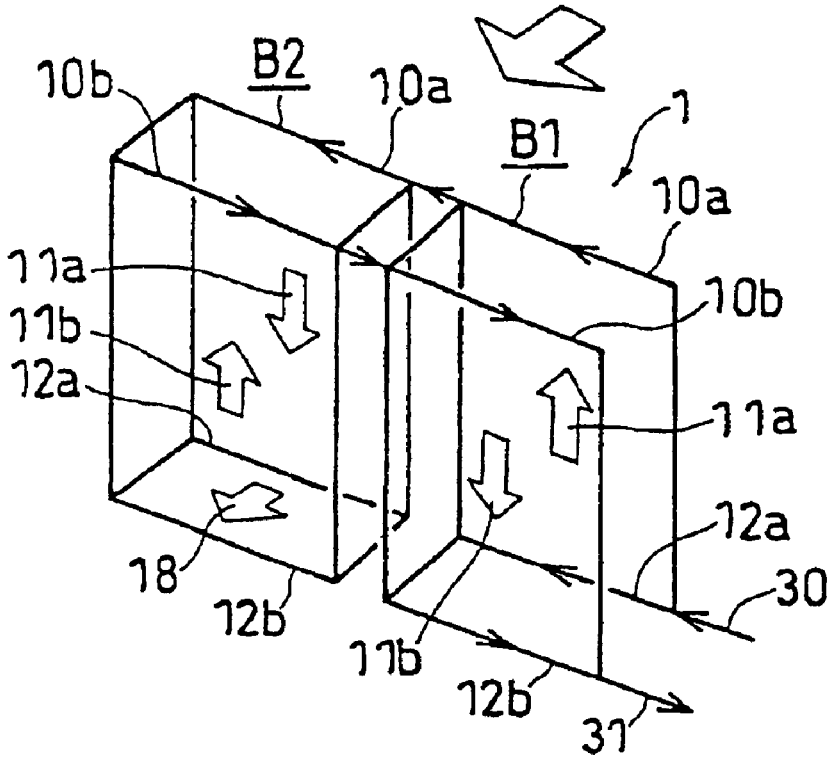
FIG. 2 is a schematic perspective view for illustrating the refrigerant circuit of the heat exchanger of FIG. 1.
Figure 3:
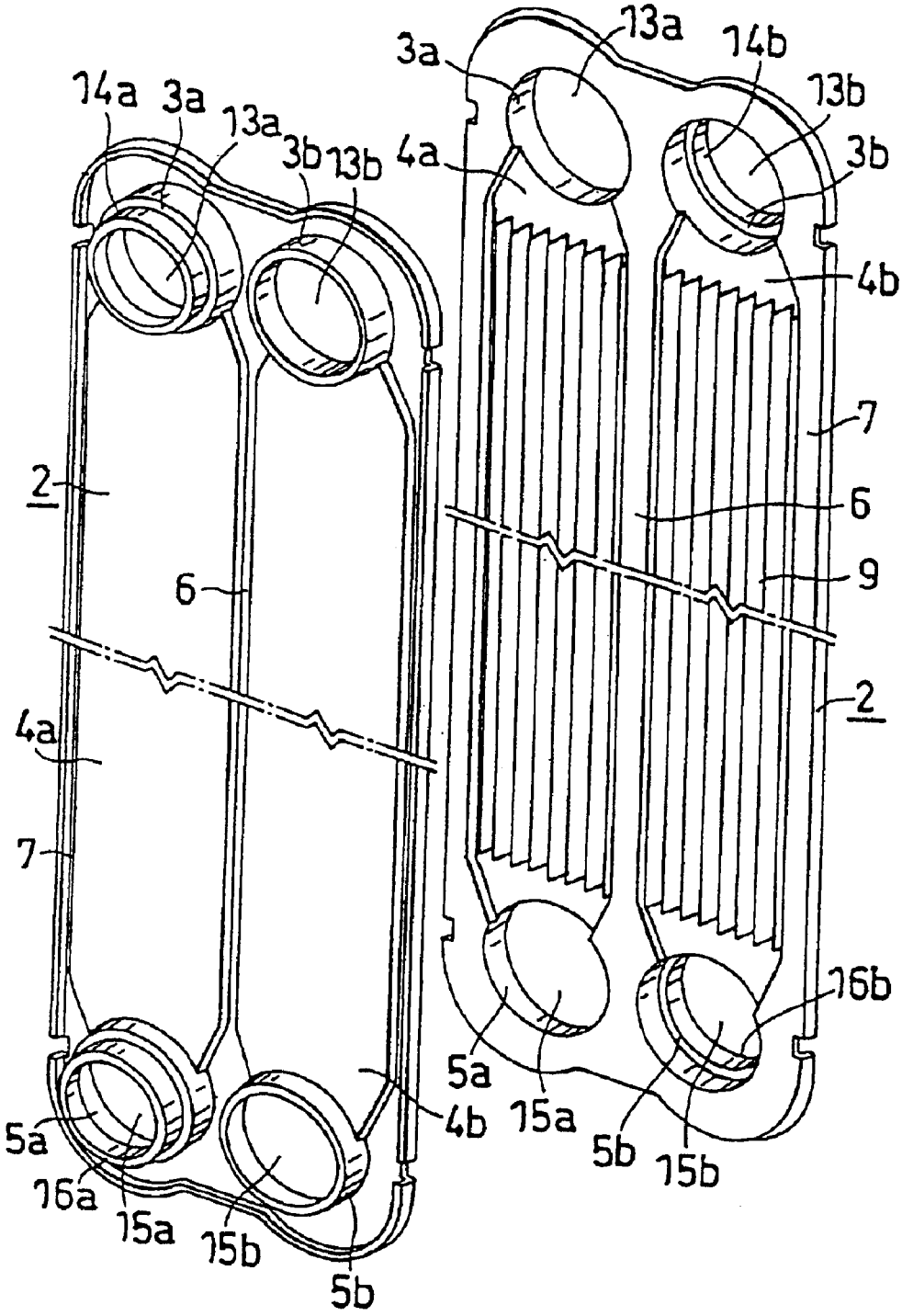
FIG. 3 is a perspective view partly broken away and showing a pair of aluminum plates of the heat exchanger.
Figure 4:
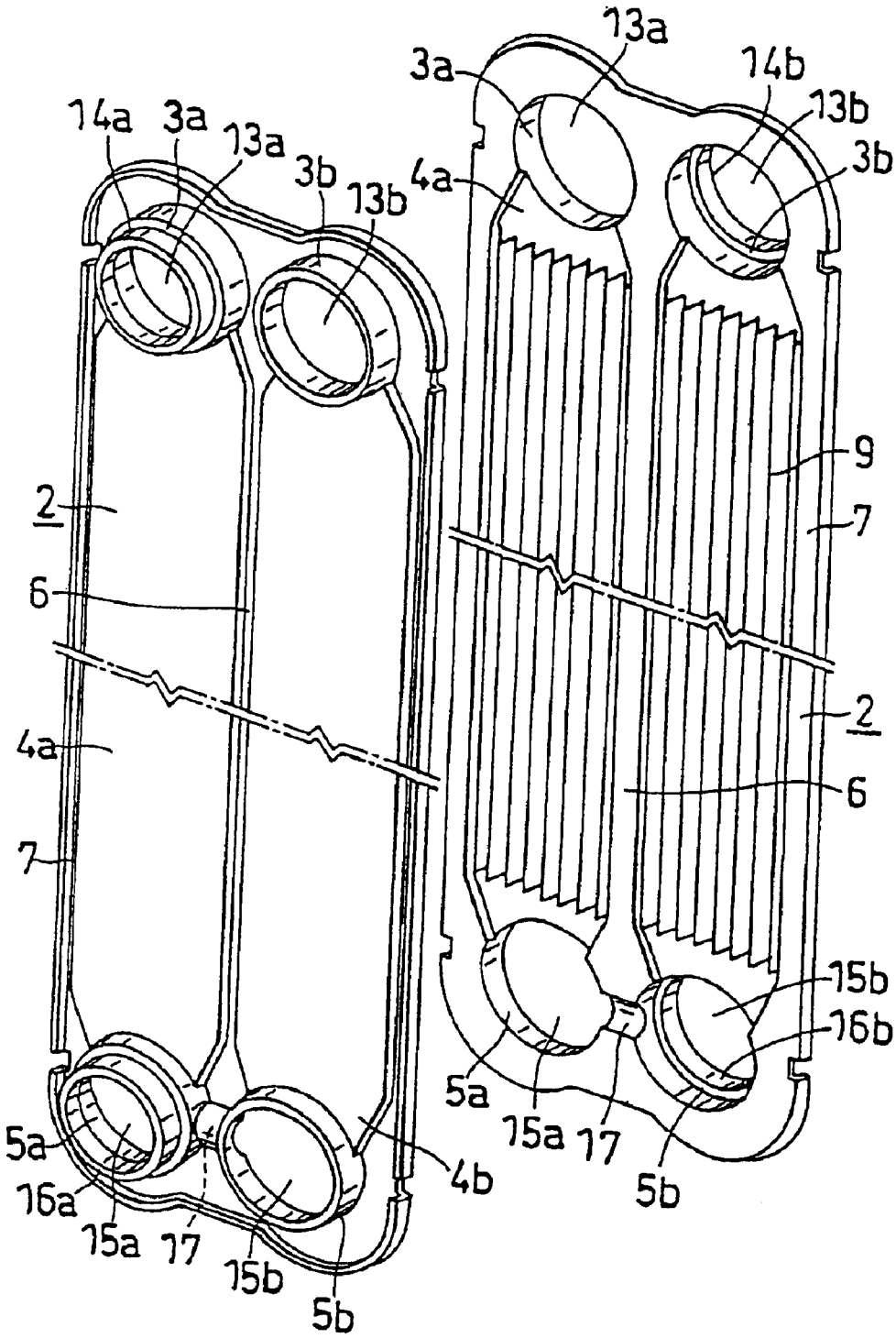
FIG. 4 is a perspective view partly broken away and showing a pair of aluminum plates each having a caved portion for forming a refrigerant flow direction changing passage.
Figure 5:
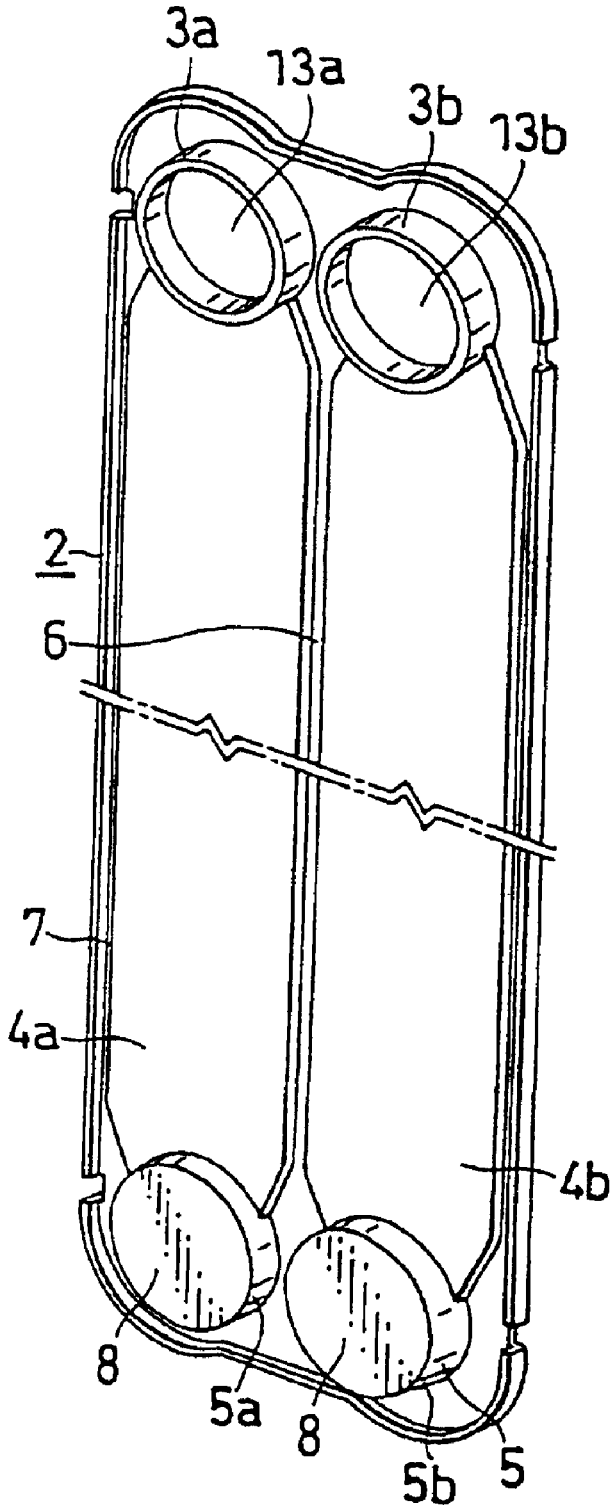
FIG. 5 is a perspective view partly broken away and showing an aluminum plate having partition walls.
Figure 6:
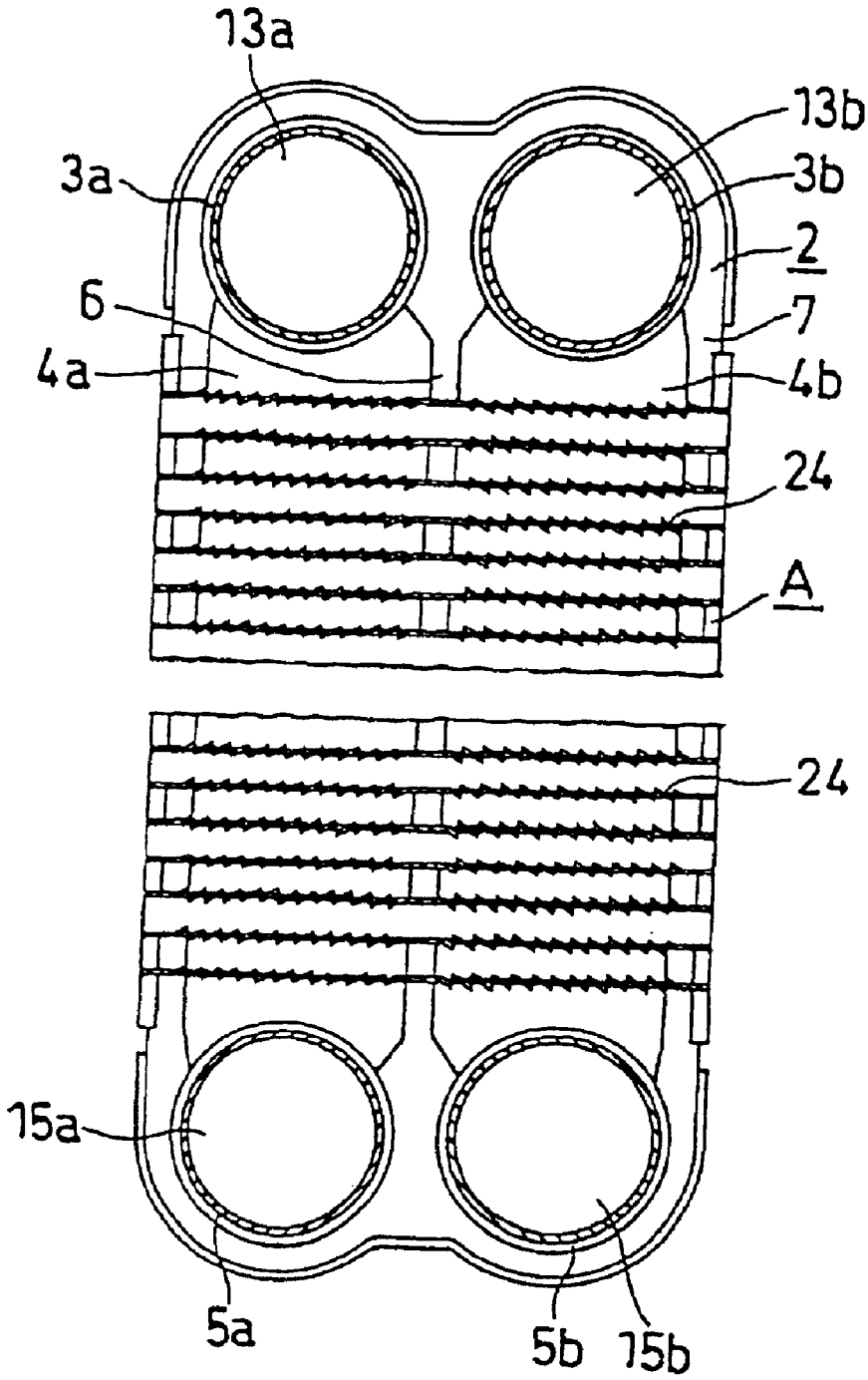
FIG. 6 is an enlarged fragmentary view in vertical section partly broken away and showing the heat exchanger of FIG. 1.
Figure 7:
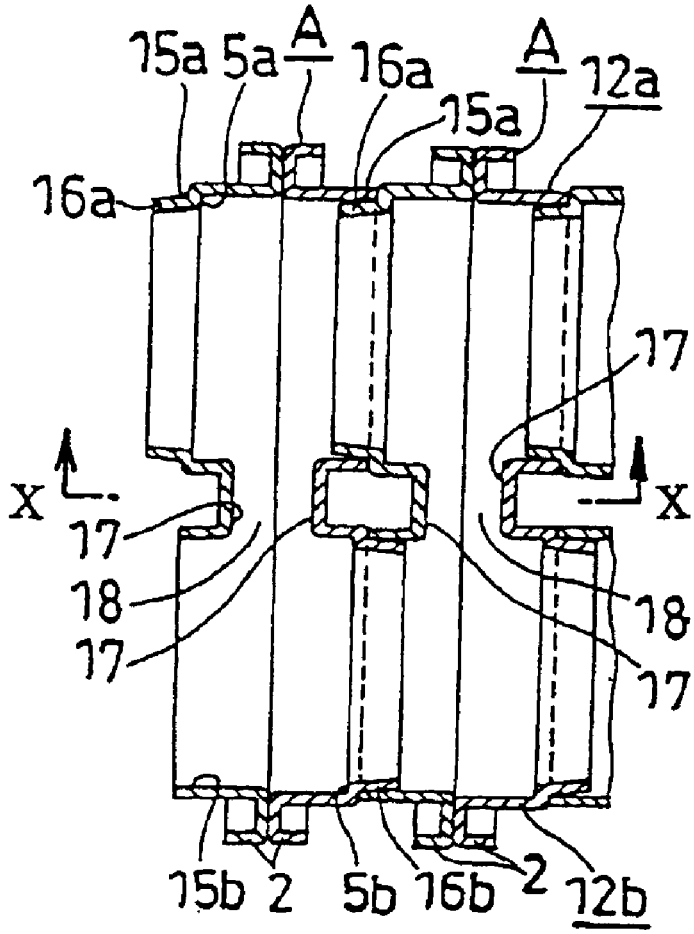
FIG. 7 is an enlarged fragmentary view in horizontal section of lower tank portions of the heat exchanger.
Figure 8:
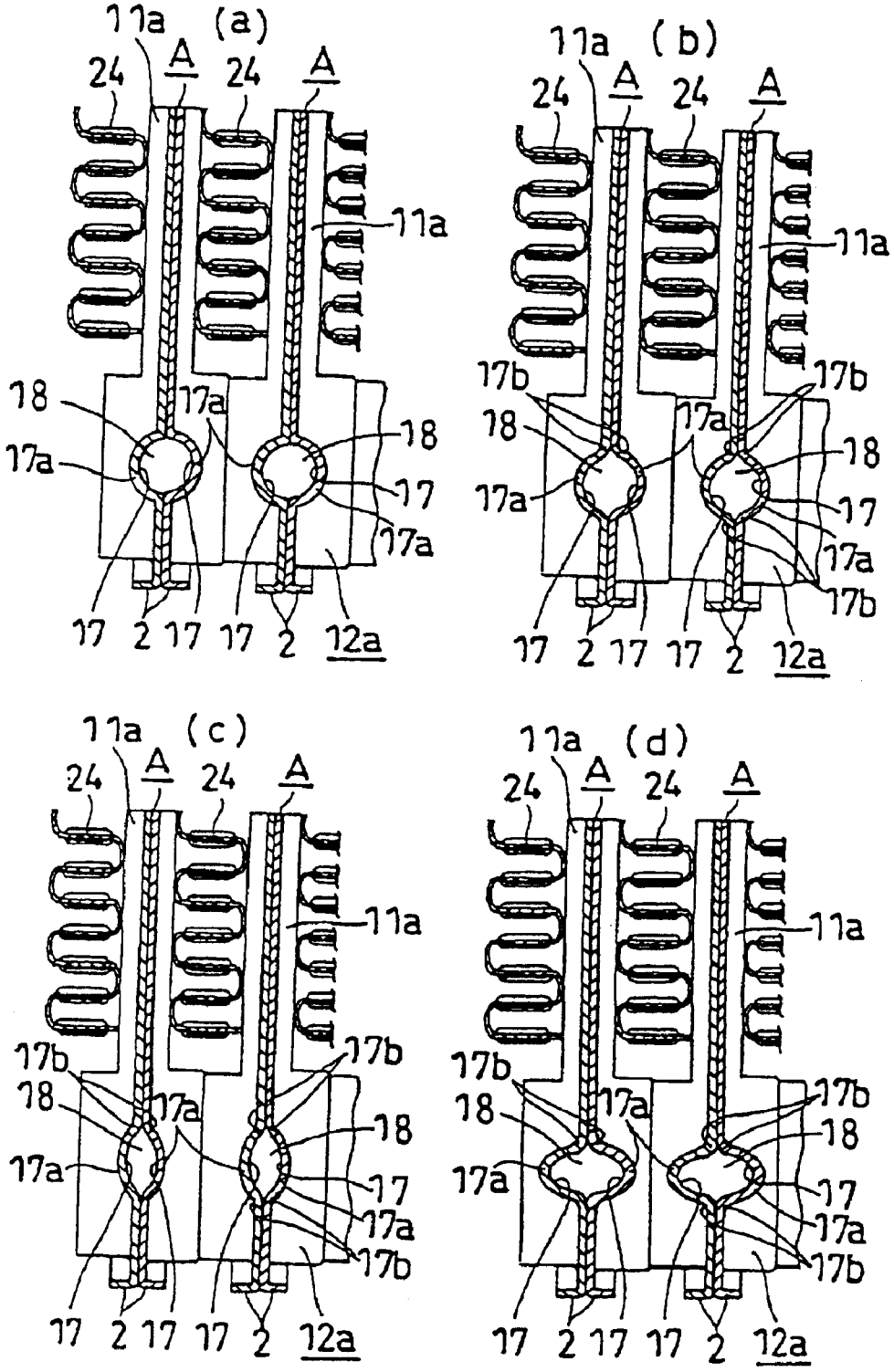
FIG. 8 includes enlarged views in section taken along the line X—X in FIG. 7.
Figure 9:
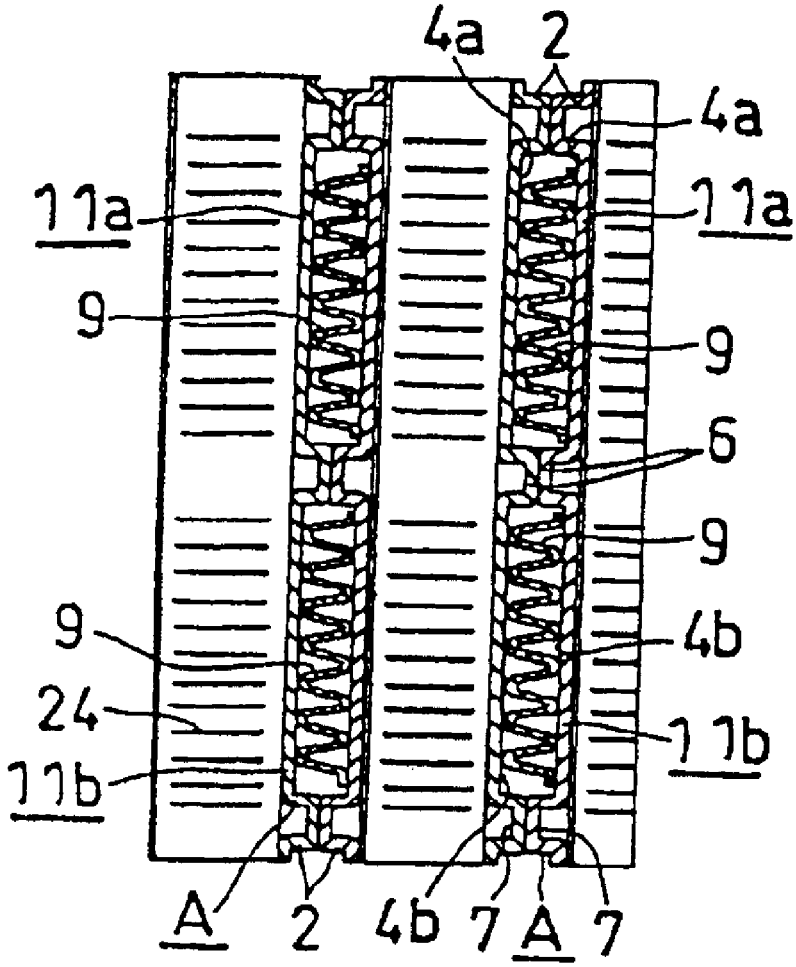
FIG. 9 is an enlarged fragmentary view in horizontal section of the heat exchanger of FIG. 1.
Figure 10:
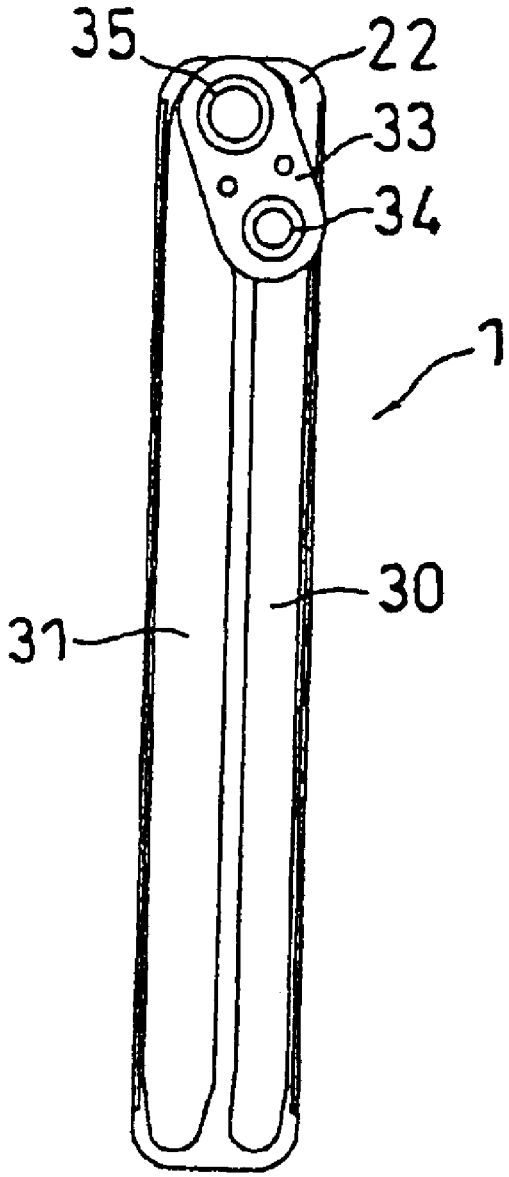
FIG. 10 is an enlarged right side elevation of the heat exchanger.
Figure 11:
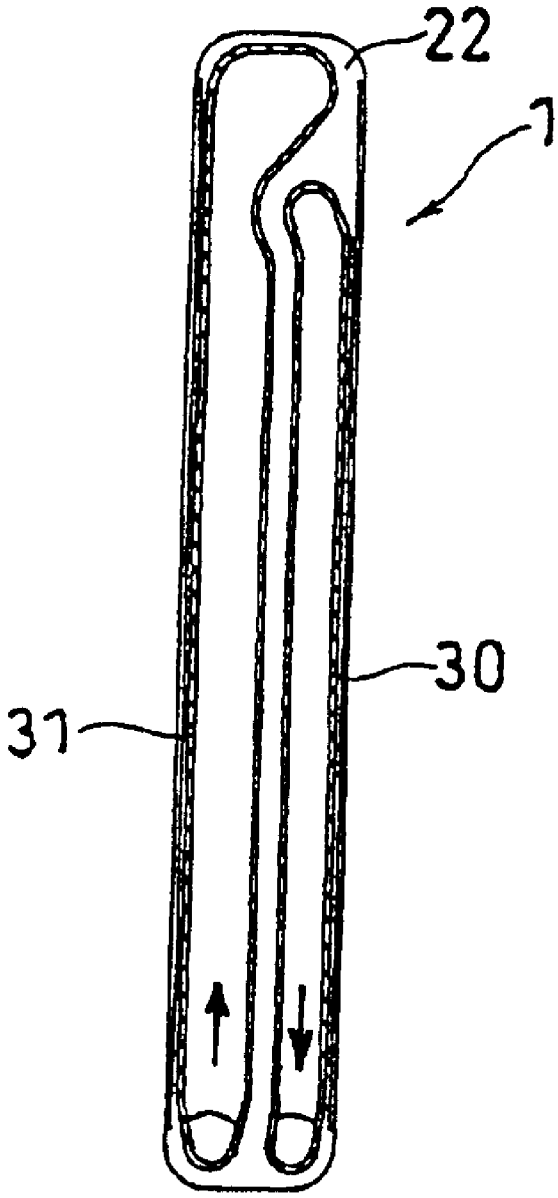
FIG. 11 is an enlarged right side elevation of the same showing refrigerant inlet and outlet pipes in section.
Figure 12:
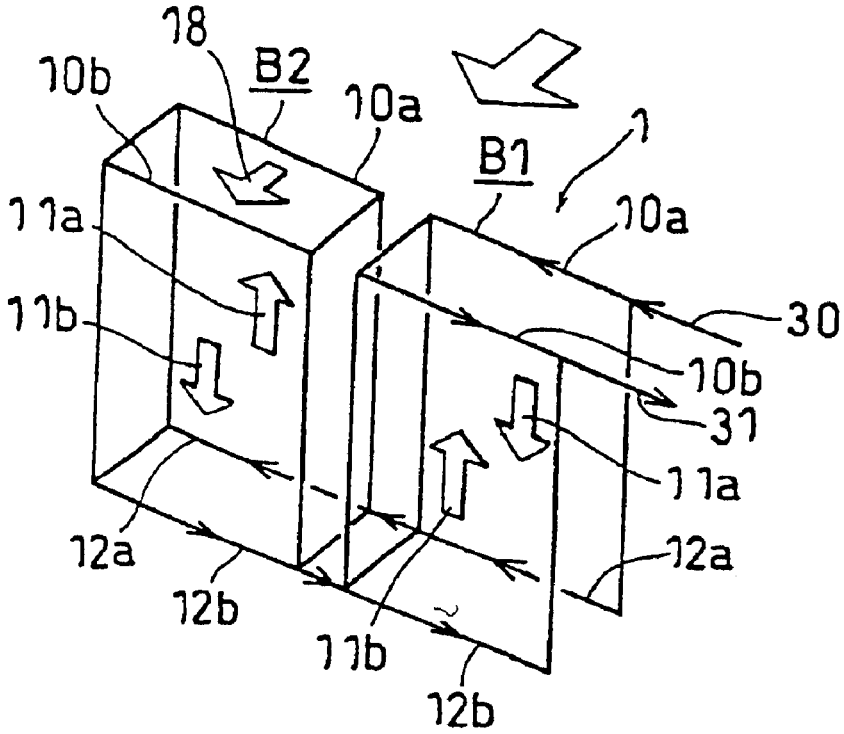
FIG. 12 is a schematic perspective view for illustrating the refrigerant circuit of second embodiment of layered heat exchanger of the invention.
Figure 13:
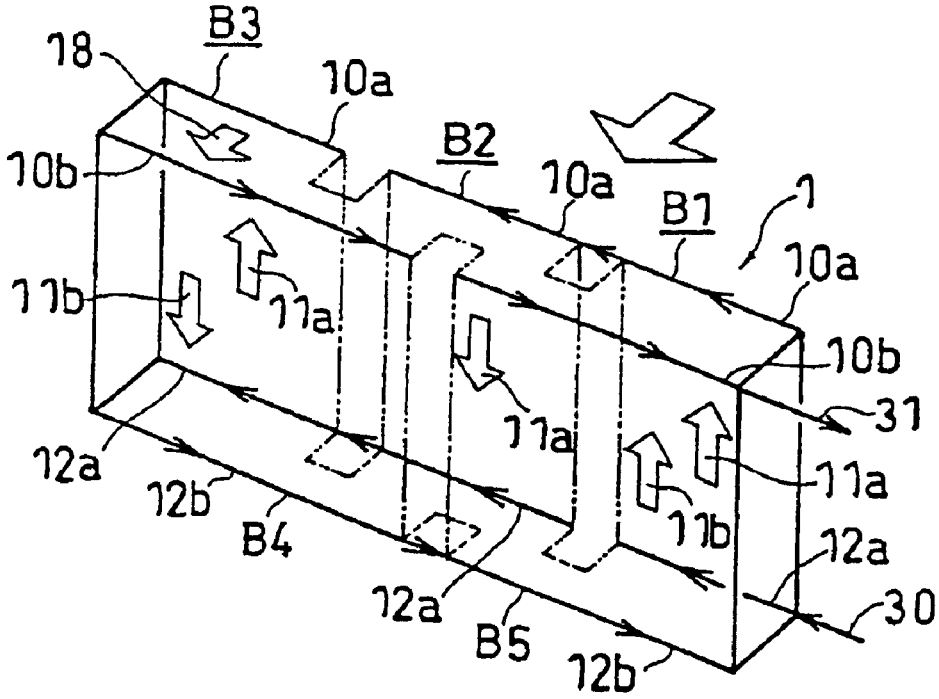
FIG. 13 is a schematic perspective view for illustrating the refrigerant circuit of third embodiment of layered heat exchanger of the invention.
Figure 14:
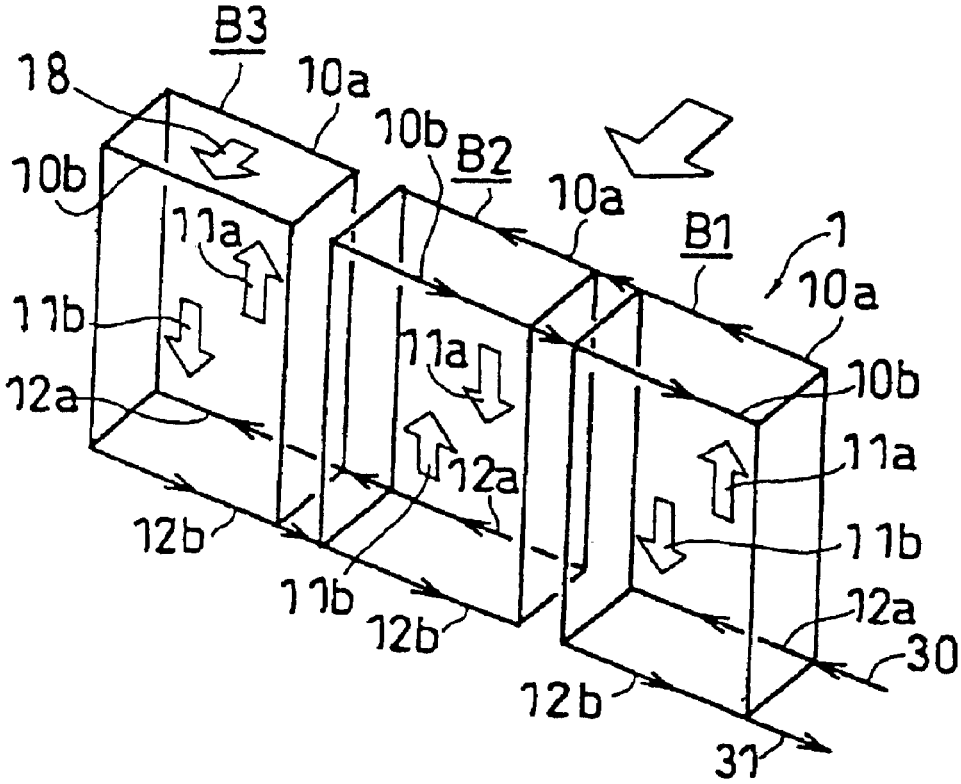
FIG. 14 is a schematic perspective view for illustrating the refrigerant circuit of fourth embodiment of layered heat exchanger of the invention.
Figure 15:
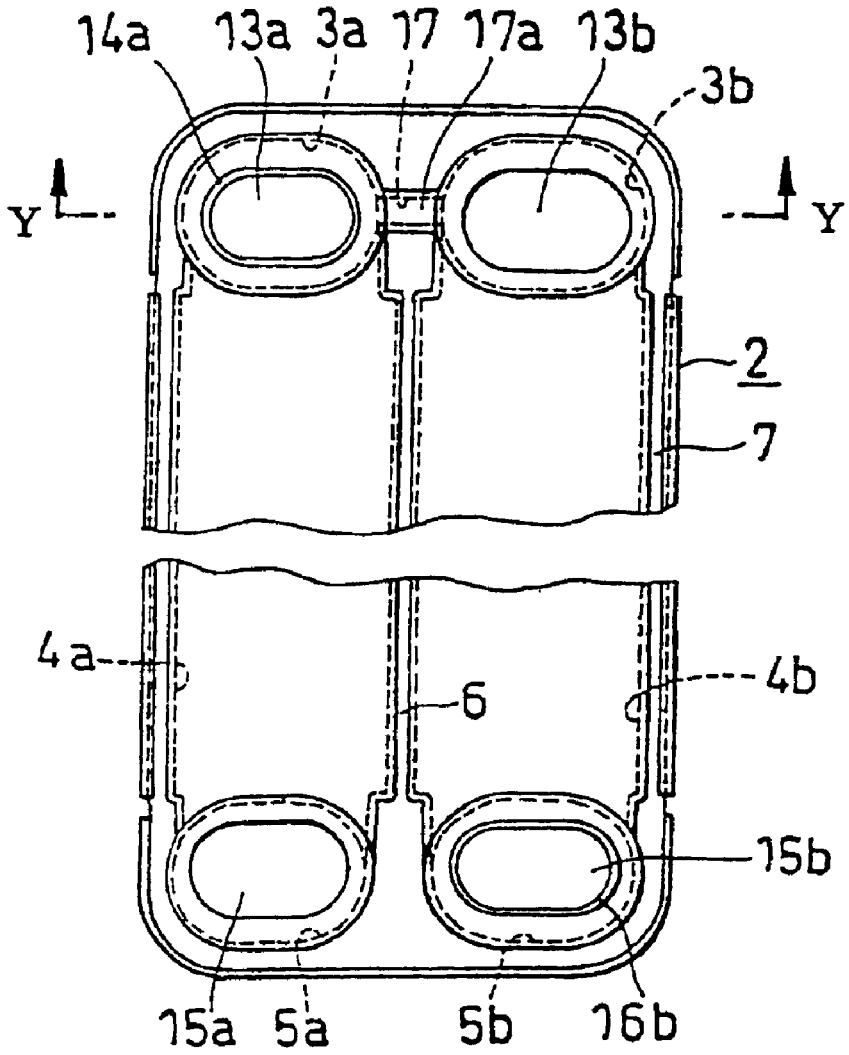
FIG. 15 is an enlarged fragmentary front view of a modified aluminum plate of the heat exchanger.
Figure 16:
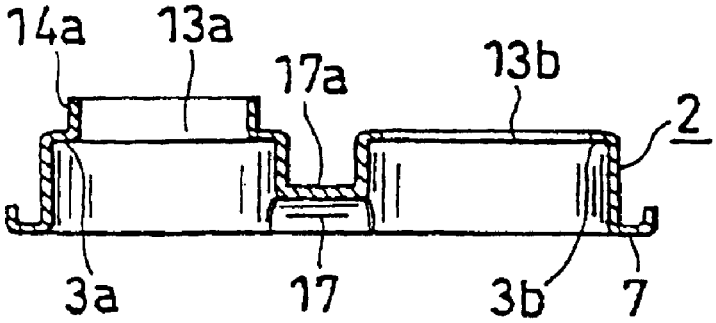
FIG. 16 is an enlarged view in section taken along the line Y—Y in FIG. 15.
Figure 17:
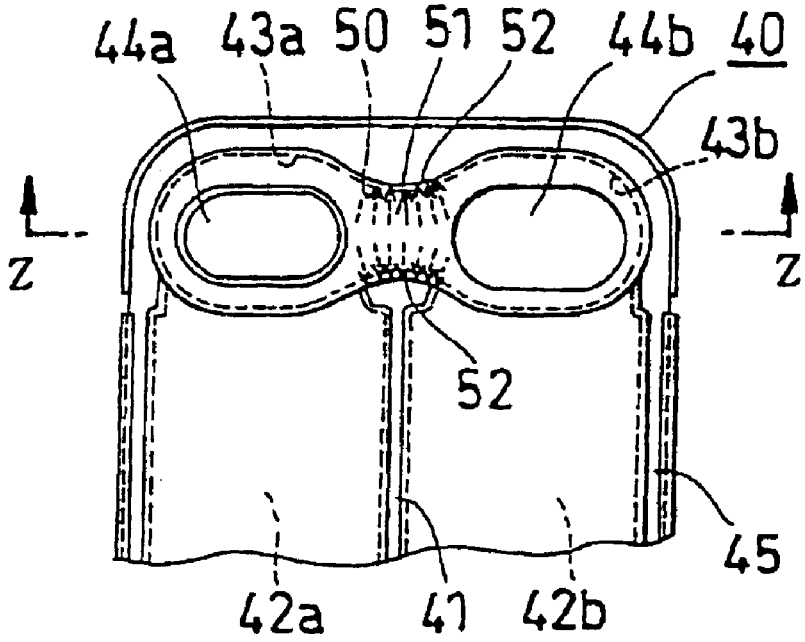
FIG. 17 is an enlarged fragmentary front view showing an aluminum plate of a conventional layered heat exchanger.
Figure 18:
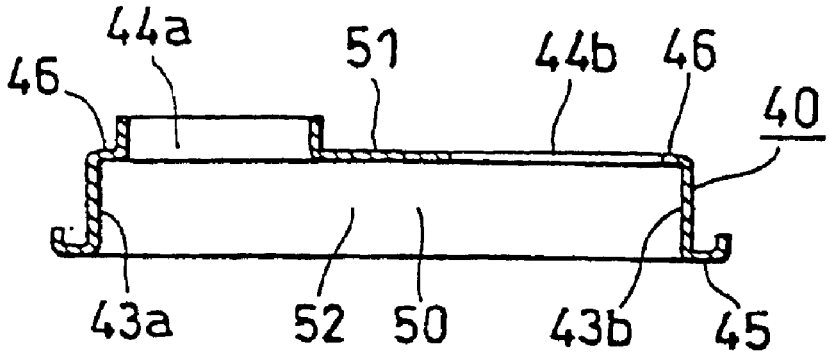
FIG. 18 is an enlarged view in section taken along the line Z—Z in FIG. 17.

1: layered evaporator (layered heat exchanger)
2: aluminum plate (metal plate)
3*a*: front upper tank forming recessed portion
3*b*: rear upper tank forming recessed portion
4*a*: front refrigerant channel forming recessed portion (front fluid channel forming recessed portion)
4*b*: rear refrigerant channel forming recessed portion (rear fluid channel forming recessed portion)
5*a*: front lower tank forming recessed portion
5*b*: rear lower tank forming recessed portion
6: partition ridge
7: peripheral edge
A: flat tube portion
10*a*: front upper tank portion
10*b*: rear upper tank portion
11*a*: front flat channel
11*b*: rear flat channel
12*a*: front lower tank portion
12*b*: rear lower tank portion
13*a*: refrigerant passage aperture (fluid passage aperture)
13*b*: refrigerant passage aperture (fluid passage aperture)
15*a*: refrigerant passage aperture (fluid passage aperture)
15*b*: refrigerant passage aperture (fluid passage aperture)
17: caved portion
17*a*: bottom wall of circular-arc cross section
18: passage having an approximately circular cross section for changing the direction of flow of the refrigerant (passage having an approximately circular cross section for changing the direction of flow of the fluid)

What is claimed is:

1. A layered heat exchanger comprising:

generally rectangular metal plates each having formed in one surface thereof front and rear fluid channel forming recessed portions divided by a vertically elongated partition ridge, front and rear upper tank forming recessed portions continuous with upper ends of these portions and having a larger depth than these portions, and front and rear lower tank forming recessed portions continuous with lower ends of these portions and having a larger depth than these portions, the front and rear upper tank forming recessed portions having respective fluid passage apertures formed in their bottom wall, the front and rear lower tank forming recessed portions having respective fluid passage apertures formed in their bottom wall, each pair of adjacent metal plates being fitted together in superposed layers with their recessed surfaces opposed to each other to join opposed partition ridges of the metal plates to each other, to join opposed peripheral edges thereof to each other and to thereby form a flat tube portion having front and rear flat channels and front and rear upper tank portions and front and rear lower tank portions which are continuous with the channels, a multiplicity of flat tube portions being arranged in parallel to cause the front upper tank portions of the adjacent parallel flat tube portions to communicate with each other, the rear upper tank portions thereof to communicate with each other, the front lower tank portions thereof to communicate with each other, and the rear lower tank portions thereof to communicate with each other, wherein the metal plate is provided at one of an upper end and a lower end of the partition ridge with a fluid flow direction changing passage forming caved portion having a bottom wall of circular-arc cross section, the front and rear upper tank portions of the flat tube portion or the front and rear lower tank portions thereof being held in communication with each other through a fluid flow direction changing passage having an approximately circular cross section and formed by the caved portions which are opposed to each other, and wherein the opposed caved portions comprise circular-arc portions corresponding respectively to angles of at least 60 degrees to less than 90 degrees each, above and below a center line of the opposed caved portions and circular arc in cross section to have a same radius of curvature.

2. A layered heat exchanger according to claim 1, wherein the bottom wall having a circular-arc cross section of the caved portion has a depth smaller than a depth of the tank forming recessed portions.

3. A layered heat exchanger according to claim 1, wherein the passage formed by the opposed caved portions has a circular cross section.

4. A layered heat exchanger according to claim 1, wherein a front side and a rear side of the heat exchanger provided respectively by the front and rear flat channels are equal in number of passes.

5. A layered heat exchanger according to claim 1, wherein a front side and a rear side of the heat exchanger provided respectively by the front and rear flat channels are different in number of passes.

6. A layered heat exchanger according to claim 5, wherein an air outlet side and an air inlet side of the heat exchanger provided respectively by the front and rear flat channels are different in number of passes, and the air outlet side is greater than the air inlet side in number of passes.

7. A layered heat exchanger comprising:

generally rectangular metal plates each having formed in one surface thereof front and rear fluid channel forming recessed portions divided by a vertically elongated partition ridge, front and rear upper tank forming recessed portions continuous with upper ends of these portions and having a larger depth than these portions, and front and rear lower tank forming recessed portions continuous with lower ends of these portions and having a larger depth than these portions, the front and rear upper tank forming recessed portions having respective fluid passage apertures formed in their bottom wall, the front and rear lower tank forming recessed portions having respective fluid passage apertures formed in their bottom wall, each pair of adjacent metal plates being fitted together in superposed layers with their recessed surfaces opposed to each other to join the opposed partition ridges of the metal plates to each other, to join opposed peripheral edges thereof to each other and to thereby form a flat tube portion having front and rear flat channels, and front and rear upper tank portions and front and rear lower tank portions which are continuous with the channels, a multiplicity of flat tube portions being arranged in parallel to cause the front upper tank portions of the adjacent parallel flat tube portions to communicate with each other, the rear upper tank portions thereof to communicate with each other, the front lower tank portions thereof to communicate with each other, and the rear lower tank portions thereof to communicate with each other, wherein the metal plate is provided at one of an upper end and a lower end of the partition ridge with a fluid flow direction changing passage forming caved portion having a bottom wall of circular-arc cross section, the front and rear upper tank portions of the flat tube portion or the front and rear lower tank portions thereof being held in communication with each other through a fluid flow direction changing passage having an approximately circular cross section and formed by the caved portions which are opposed to each other, the bottom wall circular-arc in cross section of the caved portion having a depth ¼ to ¾ to of the depth of the tank forming recessed portions.

8. A layered heat exchanger comprising:

generally rectangular metal plates each having formed in one surface thereof front and rear fluid channel forming recessed portions divided by a vertically elongated partition ridge, front and rear upper tank forming recessed portions continuous with upper ends of these portions and having a larger depth than these portions, and front and rear lower tank forming recessed portions continuous with lower ends of these portions and having a larger depth than these portions, the front and rear upper tank forming recessed portions having respective fluid passage apertures formed in their bottom wall, the front and rear lower tank forming recessed portions having respective fluid passage apertures formed in their bottom wall, each pair of adjacent metal plates being fitted together in superposed layers with their recessed surfaces opposed to each other to join opposed partition ridges of the metal plates to each other, to join opposed peripheral edges thereof to each other and to thereby form a flat tube portion having front and rear flat channels and front and rear upper tank portions and front and rear lower tank portions which are continuous with the channels, a multiplicity of flat tube portions being arranged in parallel to cause the front upper tank portions of the adjacent parallel flat tube portions to communicate with each other, the rear upper tank portions thereof to communicate with each other, the front lower tank portions thereof to communicate with each other, and the rear lower tank portions thereof to communicate with each other, wherein the metal plate is provided at one of an upper end and a lower end of the partition ridge with a fluid flow direction changing passage forming caved portion having a bottom wall of elliptical cross section, the front and rear upper tank portions of the flat tube portion or the front and rear lower tank portions thereof being held in communication with each other through a fluid flow direction changing passage having an approximately elliptical cross section and formed by the caved portions which are opposed to each other.

* * * * *